US005695435A

United States Patent [19]

Dalebout et al.

[11] Patent Number: 5,695,435

[45] Date of Patent: Dec. 9, 1997

[54] COLLAPSIBLE RIDER EXERCISER

[75] Inventors: William T. Dalebout; Richard Brad Ellis, both of Logan, Utah

[73] Assignee: ICON Health & Fitness, Inc., Logan, Utah

[21] Appl. No.: 594,846

[22] Filed: Jan. 31, 1996

Related U.S. Application Data

[63] Continuation-in-part of Ser. No. 382,342, Feb. 1, 1995.

[51] Int. Cl.[6] ..... A63B 21/00

[52] U.S. Cl. ..... 482/96; 482/57; 482/95

[58] Field of Search ..... 482/96, 95, 72, 482/57, 111, 51; 472/106, 110

[56] References Cited

U.S. PATENT DOCUMENTS

| | | | |
|---|---|---|---|
| D. 344,112 | 2/1994 | Smith . | |
| D. 356,128 | 3/1995 | Smith et al. . | |
| 2,145,940 | 2/1939 | Marlowe . | |
| 2,642,288 | 6/1953 | Bell | 482/95 |
| 3,446,503 | 5/1969 | Lawton . | |
| 4,452,448 | 6/1984 | Ausherman . | |
| 5,178,599 | 1/1993 | Scott . | |
| 5,254,067 | 10/1993 | Habing et al. . | |
| 5,299,997 | 4/1994 | Chen . | |
| 5,338,277 | 8/1994 | Yang . | |
| 5,356,357 | 10/1994 | Wang et al. . | |
| 5,366,428 | 11/1994 | Liao . | |
| 5,370,594 | 12/1994 | Grinblat . | |
| 5,421,795 | 6/1995 | Chen | 482/96 |
| 5,423,731 | 6/1995 | Chen . | |
| 5,429,568 | 7/1995 | Chen . | |
| 5,453,066 | 9/1995 | Richter, Jr. . | |
| 5,458,553 | 10/1995 | Wu . | |
| 5,464,378 | 11/1995 | Yu . | |
| 5,478,298 | 12/1995 | Chen . | |
| 5,503,608 | 4/1996 | Chang . | |
| 5,507,710 | 4/1996 | Chen . | |
| 5,520,599 | 5/1996 | Chen . | |

OTHER PUBLICATIONS

Polaroid photographs of EXEROW machine with diagram.
Diagram of EXERCYCLE machine.
Cover page of Damark catalog dated May 1995 showing CSA's E-FORCE riding machine.
Cover page of Damark catalog dated Feb. 1996 showing POWER RIDER riding machine.
Cover page and p. 35 of Damark catalog dated Jul. 28, 1994 showing Voit's GRAVITY RIDER riding machine.
User's Manual for WESLO CARDIOTRAINER—1995.
User's Manual for Lifestyle CARDIO FIT—1994.
User's Manual for AEROBICRIDER.
User's Manual for CARDIO-TRAINER 456—undated.
Exerhealth's HEALTHRIDER Parts Description—dated Apr. 26, 1994.
User's Manual for Guthy-Renker Fitness' POWER RIDER—undated.

*Primary Examiner*—Jerome Donnelly
*Attorney, Agent, or Firm*—Trask, Britt & Rossa

[57] ABSTRACT

A riding exerciser has a support member rotatably secured to a base at the front end of the base. Limb structure is also rotatably secured to the support member. The lower end of the limb structure has wheels which rotate on cams as the user operates between a first position and a second position. The machine may be reconfigured between a use configuration in which it may be operated between the first position and the second position and a forward configuration in which the handle and the support member are placed in general alignment with and proximate the base.

11 Claims, 6 Drawing Sheets

COLLAPSIBLE RIDER EXERCISER

This application is a continuation-in-part of application Ser. No. 08/382,342 filed Feb. 1, 1995, which is now pending.

BACKGROUND OF THE INVENTION

1. Field of the Invention

This application relates to exercise machines of the type in which the user rides on a seat while pushing and/or pulling on limb structure with hands and feet.

2. State of the Art

Exercise machines in which the user mounts the machine and in effect rides the machine in the performance of exercises include U.S. Pat. No. 4,300,760 (Bobroff). The user mounts the machine and operates a lever mechanism with the arms and the feet against the resistance, which is the user's weight positioned upon a seat.

Commercial rider machines are known including the HEALTHRIDER™ manufactured and sold by HealthRider, Inc. of Salt Lake City, Utah. The HEALTHRIDER machine has a frame with a rotatable or movable lever interconnected through straps to a seat. The lever is operated by the user's hands and feet against the resistance of the user residing or sitting on the seat in a fashion similar to that illustrated in the Bobroff patent.

Other known exercise machines of the riding type are powered by a motor to move the seat and the movable handle structure. U.S. Pat. No. 3,446,503 shows another type of rider machine.

Typical riding type machines require some assembly or are otherwise bulky in size or shape, requiring some amount of space for storage.

SUMMARY OF THE INVENTION

A riding exerciser includes a base for positioning on a support surface. The base has a front end and a rear end. The base has a guide surface positioned between the front end and the rear end.

The riding exerciser includes user support means for supporting a riding user thereon. The user support means has a support member movably attached to the base for movement relative to the base. The user support member has a user contact structure such as a seat for contact by a riding user. The support member is configured to be movable between a storage configuration in which the support member is positioned proximate the base and a use configuration in which the support member is positioned to receive a riding user on the user contact structure. The support member is also configured to be movable between a first position and a second position spaced upwardly from the first position when in the use configuration.

The riding exerciser also includes limb structure rotatably attached to the support member. The limb structure has an upper end with handle structure for grasping by the user positioned on the user support means in the use configuration. The limb structure also has a lower end with guide means for contact with and movement along the guide surface of the base. The limb structure is mounted to the base and shaped so that it is movable between a storage configuration in which the limb structure is positioned proximate to and in general alignment with the support member and a use configuration in which the limb structure is oriented with the handle structure positioned for grasping by a user positioned on the user contact structure. When in the use configuration, the limb structure is mounted to be movable between a first position and a second position spaced away from the first position.

The riding exerciser further includes resistance means for resisting movement of the user support means and the limb structure. The resistance means is interconnected between any two of the limb structure, the user support means and the base.

In a preferred arrangement, the limb structure has foot supports mounted to and proximate its lower end to receive the feet of a user positioned on the user contact structure when the riding exerciser is in the use configuration.

In a more preferred arrangement, the guide means includes wheel means rotatably mounted at the lower end of the limb structure to rotate in movement along the guide surface. The support member is preferably a beam having one end rotatably mounted to the base with the user contact structure positioned proximate its other end.

The limb structure desirably is a pair of spaced apart members with the support member or beam extending thereinbetween. The base is also preferably a pair of spaced apart beams with a front foot attached proximate their front end and a rear foot attached proximate their rear end. The front foot and the rear foot provide for a foot print to stabilize the unit in use and also to provide structure for contact with the support surface.

Wheel means desirably includes a wheel rotatably attached at each of the lower ends of each of the pair of spaced apart members. The wheels are in contact with a surface of each of the spaced apart beams of the base. In a more preferred arrangement, each spaced apart beam has a cam surface for contact with the wheel of the limb structure in the use configuration.

In one preferred arrangement, the resistance means includes a hydraulic cylinder rotatably connected at one end to the support member and rotatably connected at its other end to the base.

In an alternate configuration, the support member is rotatably connected to the base by axle structure. The resistance means is compressive resistance structure associated with the axle structure. In another alternate configuration, the limb structure is rotatably attached to the support member by limb axle structure. The resistance means is compressive resistance structure associated with the limb axle structure.

In a yet alternate arrangement, the limb structure includes a portion which extends between the limb axle and the wheels. The portion extending between the limb axle and the wheels is arcuately formed to extend rearwardly. It is also sized in effective length to be proximate the distance between the limb axle and the support axle.

BRIEF DESCRIPTION OF THE DRAWINGS

In the drawings which illustrate what is presently regarded to be the preferred embodiments.

DETAILED DESCRIPTION OF THE DRAWINGS

Figure 1:
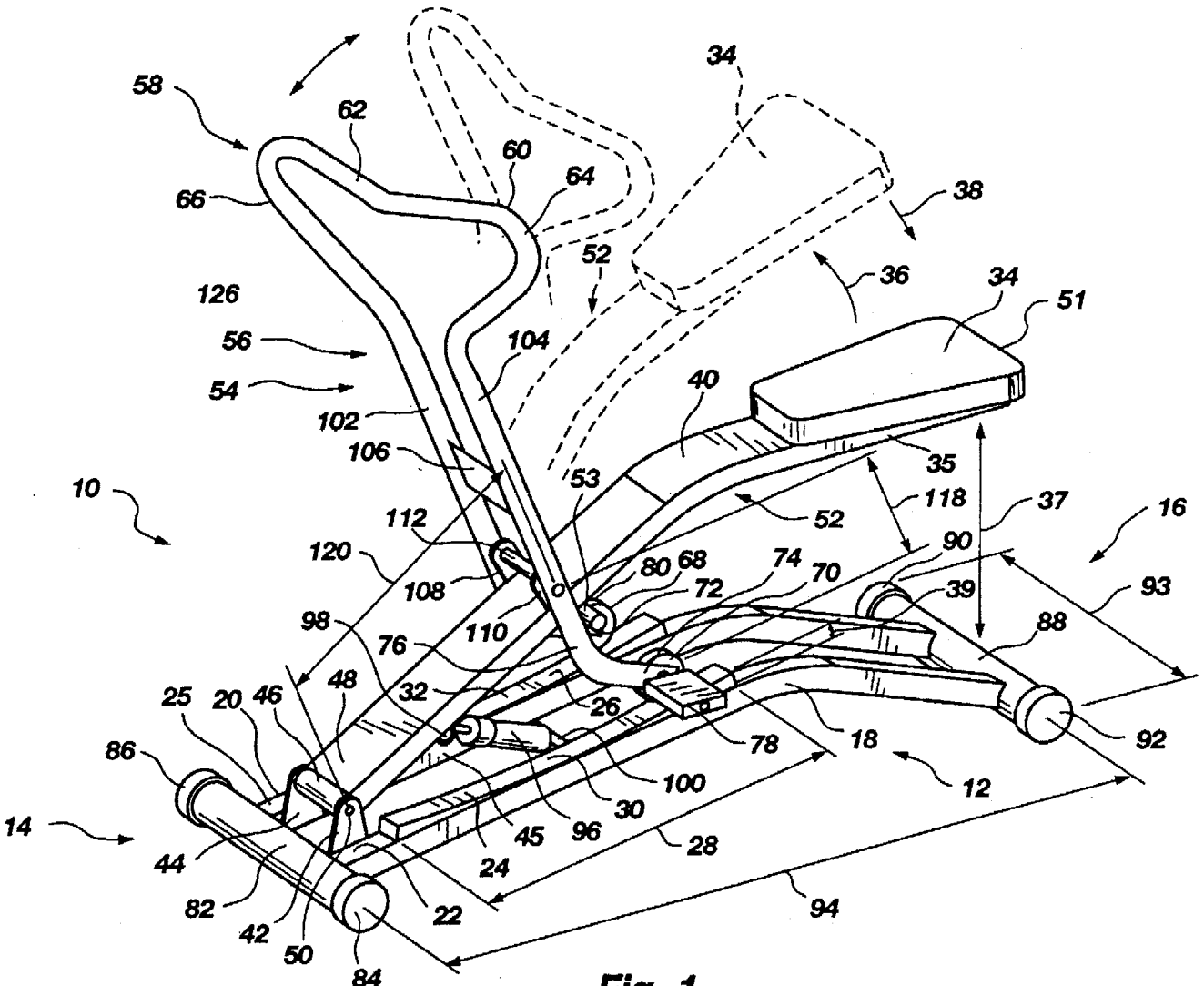
FIG. 1 is a perspective illustration of a riding exerciser of the invention in a use configuration.

In FIG. 1, a riding exerciser 10 is shown having a base 12 for positioning on a support surface. The base 12 has a front end 14 and a rear end 16. The base 12 has a guide surface positioned between the front end 14 and the rear end 16. In the embodiment of FIG. 1, the base 12 is comprised of a left beam 18 and a right beam 20. The upper surfaces 22 and 25 of the left beam 18 and the right beam 20, respectively, have cam surfaces 24 and 26.

Cam surfaces 24 and 26 shown have a length 28 and are arcuate. That is, the cam surfaces 24 and 26 each have an outwardly facing arcuate surface 30. The cam surfaces 24 and 26 are each configured to position the user contact structure such as seat 34 in a desired location and to cause the seat 34 to be positioned at a desired height 37 above the base 12. The cam surface may adjust in thickness 39 to cause the seat 34 to change in height or to move 36 in downward direction 38 when in the first position of the use configuration.

The riding exerciser of FIG. 1 has user support means for supporting a riding user thereon. In FIG. 1, the user support means includes a support member 40 and a user contact structure which is seat 34. The support member 40 is movably attached to the base 12. More specifically, the support member 40 is attached to the base 12 by a bracket assembly that includes a left bracket 42 and a right bracket 44. The left bracket 42 is welded or otherwise affixed to the interior surface of the left beam 18, and the right bracket 44 is welded or otherwise affixed to the interior surface of the right beam 20. The support member 40 has a bushing 46 secured to its lower end 48. An axle 50 extends through the bushing 46 to provide for rotational movement of the user support means and more particularly the support member 40 from a first position 51 shown in solid in FIG. 1 to a second position 52 shown in dotted line or phantom in FIG. 1. A stop 53 is welded or otherwise attached to the support member 40 at a location along the length of the support member 40 to fix the first position of the user support means.

The riding exercise of FIG. 1 also includes limb structure 54 that is rotatably attached to the support member 40. The limb structure 54 has an upper end 56 with handle structure 58 positioned for grasping by a user positioned on the user support means and more particularly the seat 34. As here shown, the handle structure 58 is a continuous bar arrangement 60 having a top 62 as well as a left side 64 and a right side 66. With the configuration provided, the user can position his or her hands in various orientations along the arcs of the handle structure 58 to in turn vary the nature of the exercise and the muscles engaged in performing exercise. Other handle arrangements such as a T-handle may be used as desired.

The limb structure 54 of FIG. 1 has guide means for contact and movement along the guide surface. The guide means are here shown to be a right wheel 68 and a left wheel 70 each rotatably mounted to their respective lower ends 72 and 74 of the lower portion 76 of the limb structure 54. The wheels 68 and 70 are rotatably mounted to move along a respective guide surface. The guide surface may be the top 25 of the right beam 20 and the top 22 of the left beam 18. However, in the illustrated embodiment, the guide surface specifically includes the surfaces 30 and 32 of the cam surfaces 24 and 26. Therefore, in operation upon movement of the limb structure between a first position and a second position displaced from the first position, the wheels 68 and 70 move along the cam surfaces 30 and 32.

It can also be seen in FIG. 1 that a pair of foot pedals 78 and 80 are also attached at the lower ends 72 and 74 of the limb structure 54. The user may position his or her feet therein in the performance of exercises to urge the limb structure to move from the first position to the second position (shown in phantom in FIG. 1) by exerting a pressure or force on the pedals 78 and 80.

In reference to FIG. 1, right beam 20 and left beam 18 are each fixedly attached, such as by welding, to a front foot 82 that has friction structure 84 and 86 secured to the outward ends thereof for contact with the support surface. Similarly, a rear foot 88 is attached such as by welding to the right beam 20 and left beam 18 with similar friction structure 90 and 92 for contact with the support surface. The feet 82, 88 have width 93 selected to provide the riding exerciser with sufficient sideways stability. That is, the width 93 and the length 94 together provide a foot print to stably support the exerciser 10 on a support surface.

In FIG. 1, resistance means is also seen comprised of a resistance cylinder 96 rotatably connected by a bolt 98 to the support member 40 and by a bushing and bolt structure 100 to the base 12. The resistance cylinder 96 may be non-adjustable; or it may be of the adjustable variety as more fully described in the parent application hereto Ser. No. 08/382,342 filed Feb. 1, 1995 the specification of which is incorporated herein by reference.

Figure 6:
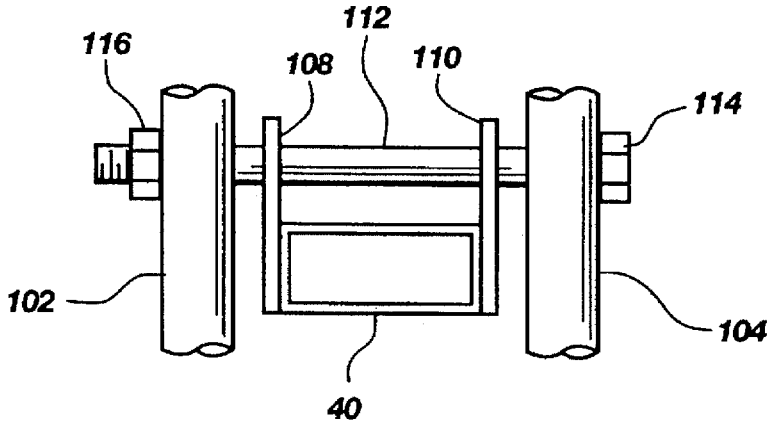
FIG. 6 is a partial, simplified view of a portion of the riding exerciser of FIGS. 1 and 2.

Referring back to the limb structure 54, it can be seen that the limb structure is comprised of a spaced apart right member 102 and a left member 104 interconnected by a stiffener 106. The right member 102 and left member 104 straddle the support member 40 and are connected thereto through straps 108 and 110 and an interconnecting axle 112 as better seen in FIG. 6. More specifically, the right member 102 and left member 104 are rotatably secured by the interconnecting axle 112 that has a head 114 and a nut 116 threaded thereon in a conventional manner.

Referring back to FIG. 1, it should also be noted that the lower portion 76 of the limb structure 54 extends downwardly a preselected distance 118 that is similar to the distance 120 between the limb axle 112 and the support axle 50. That is, the effective length 118 is selected so that upon rotation of the limb structure 54 from a use configuration as shown in solid in FIG. 1 to a stored configuration shown in FIG. 2, the wheels 68 and 70 move to a position proximate the support axle 46.

Figure 2:
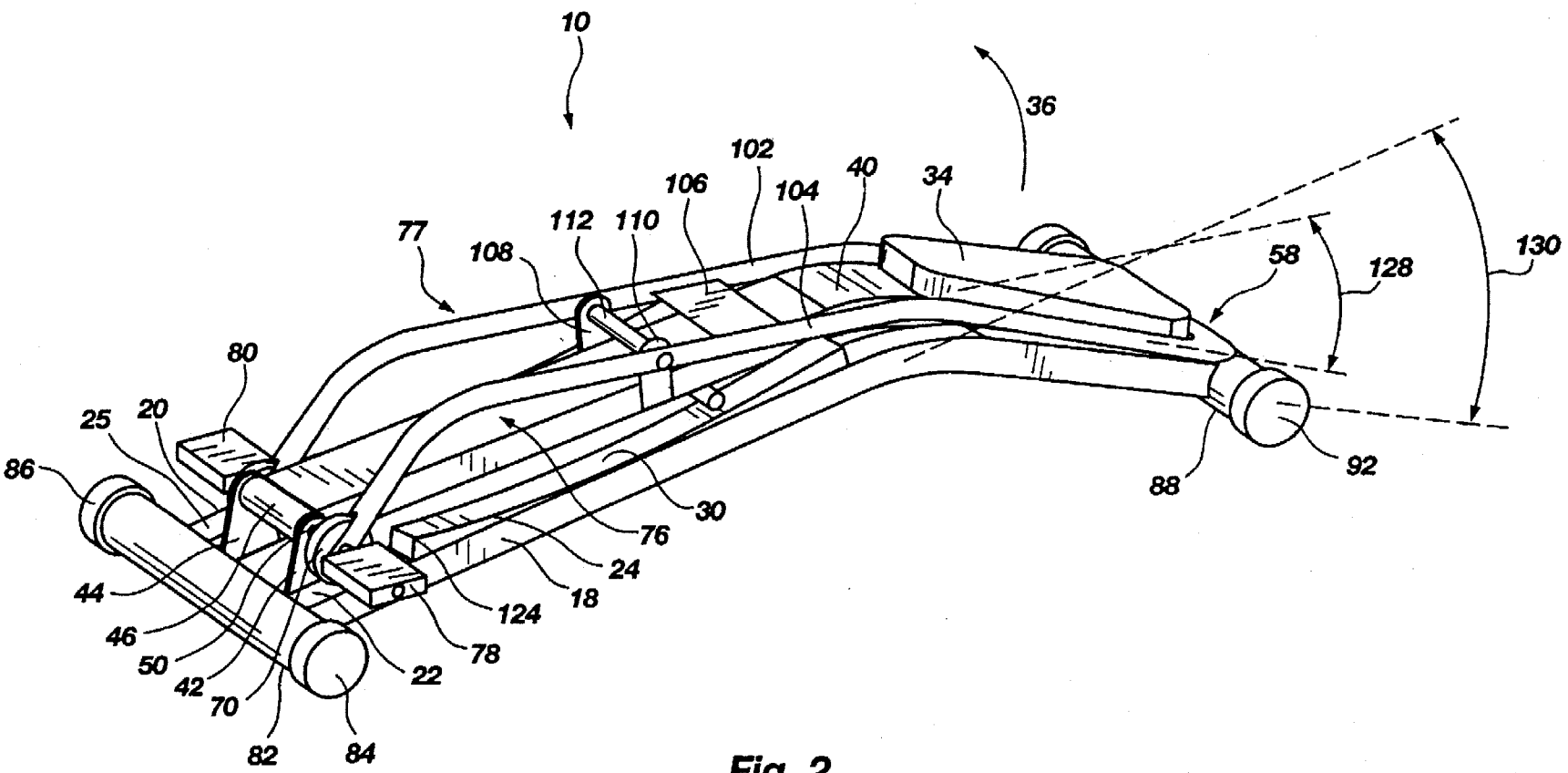
FIG. 2 is a perspective view of the riding exerciser of FIG. 1 in a storage configuration.

It may also be noted that the lower portion 76 of the limb structure 54 is arcuately shaped so that upon rotation of the limb structure 54 from its use configuration shown in solid in FIG. 1 to a storage configuration shown in FIG. 2, the handle structure 58 may be sufficiently rotated to be positioned proximate the seat 34.

As hereinbefore stated, the riding exerciser 10 disclosed may be positioned in a use configuration as shown in FIG. 1. When in the use configuration, the exercise machine 10 may be operated between a first position and a second position. That is, when the limb structure 54 is connected to the support member 40 as shown in FIG. 1, movement of the limb structure 54 from the first position 51 shown in solid to the second position 52, partially shown in phantom or in dotted line, results in simultaneous movement of the support member 40 means from the first position 51 shown in solid in FIG. 1 to the second position 52 partially shown in phantom in FIG. 1.

To place the exercise machine of FIG. 1 in its storage configuration as shown in FIG. 2, the user dismounts from the seat 34 and while dismounted operates the limb structure 54 from the user configuration shown in FIG. 1 and more particularly from the first position 51 shown in solid in FIG. 1 through the second position 52 shown in phantom or dotted line in FIG. 1 to the storage configuration shown in FIG. 2. In so doing, the wheel 70 rolls along the cam surface 30 and over the forward edge 124 to a position forward of the cam surface 24 on the top of the left beam 18 and more particularly the surface 22. The wheel 68 on the right side similarly moves over the cam surface 32 and onto the surface 25 of the right beam 20. In such a position, the handle structure 58 extends rearward and over the seat 34. That is, the area 126 (FIG. 1) defined by the right member 102 and the left member 104 as well as the left and right sides 66,68 and the top portion 62 is greater than the projected area of the seat 34 so that the seat 34 may fit therethrough. Further, the right member 102 and the left member 104 are spaced apart so that the support member 40 may readily extend upward to a position where it is in contact with the stiffener 106. It may also be noted that the handle structure 58 of the limb structure 54 is arcuate. That is, the handle structure 58 is disposed to be at an angle 128 relative to the right member 102 and left member 104. As so shaped, the handle sturcture 58 fits generally in alignment with the seat 34 and the upper sturcture 35 of the support member 40.

The right member 102 and the left member 104 are not parallel to the beams 18 and 20. That is, the handle structure 58 is in substantial alignment to the beams 18 and 20. The lower portion 76 and the middle portion 77 of the limb structure 54 is positioned close to and, what is here defined as, in general alignment with the right beam 20 and the left beam 18. The lower portion 76 angulates down towards the beams 18 and 20 and thereby remains in contact with the upper surfaces 22 and 25. The weight of the support member 40 and seat 34 through the axle 112 urges the limb structure 54 downward and about the support member 40 and seat 34. The wheels 68 and 70 act as a fulcrum.

When positioned in the storage position, it can be seen that riding exerciser 10 is compact and therefore readily storable in a closet, potentially under a bed or even behind a piece of furniture. It may further be noted that the riding exerciser 10 of FIG. 2 may be assembled and shipped in a substantially assembled condition to minimize assembly difficulties for the purchaser without use of an excessively large box with all the costs attendant to the use of a large box.

In order to reconfigure the riding machine 10 of FIG. 2 from the storage position shown in FIG. 2 to a use configuration as shown in FIG. 1, the user need only move the handle structure 58 upward thereby causing the rollers 70 and 68 to proceed up over their respective lips, such as edge 124 at one end of the cam surfaces 30 and 32. Simultaneously, the user support means and more particularly the support member 40 is moved upward and into the use configuration for operation as shown in FIG. 1. In practice, the user may find operation or manipulation of the limb structure 54 to be facilitated by placing the user's foot on the rear foot 88 to stabilize the unit when moving from the storage configuration to the use configuration. Of course, the user may also find it convenient to place the toe or foot of the user on the forward foot 82 when otherwise moving the riding exerciser 10 between the use configuration and the storage configuration.

Figure 3:
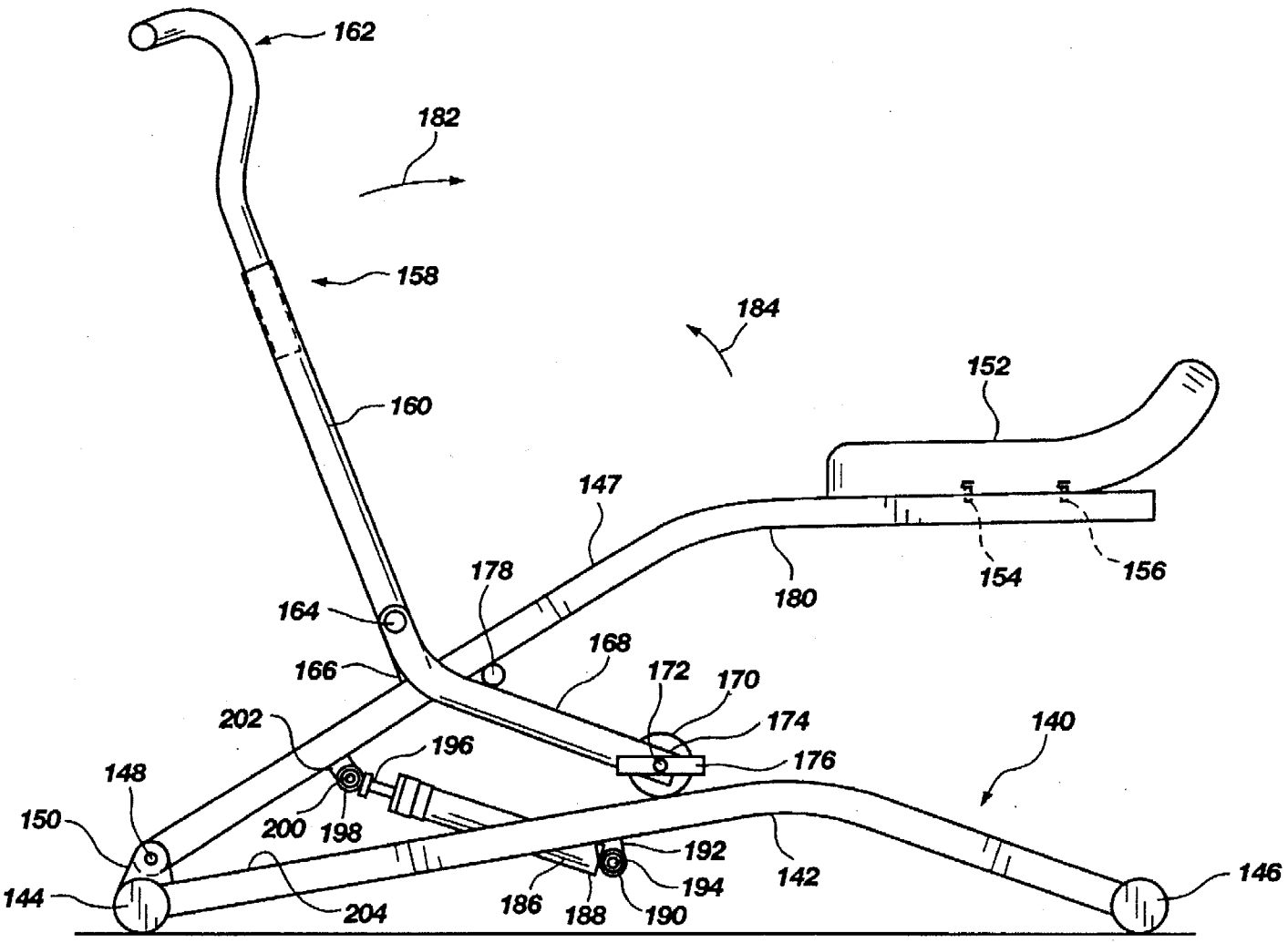
FIG. 3 is a simplified side view of an alternate riding exerciser of the invention.

FIG. 3 shows an alternate configuration of the riding exerciser in which the base 140 has a left beam 142 and a right beam not shown. The left beam 142 and the right beam are each secured to a front foot 144 and a rear foot 146. User support means is here shown to include a support member 147 rotatably attached by an axle 148 to bracket structure 150 comparable to the bracket structure 42 and 44 shown in FIGS. 1 and 2. The user support means includes a seat 152 which is secured to the support member 146 by a plurality of screws or bolts 154 and 156.

Limb structure 158 is comprised of a left member 160 and a right member (not shown) extending upwardly to a handle portion 162. The limb structure 158 is rotatably secured by a limb axle 164 to a bracket or strap structure comparable to strap structure 110 and 108 shown in FIGS. 1 and 2. The strap structure of FIG. 3 includes a left strap 166 and right strap (not shown) that are secured to the support member 146 to extend generally upward therefrom.

The limb structure 158 also includes a lower portion 168 with a left wheel 170 rotatably secured about an axle 172 to the distal end 174 of the lower portion 168. A right wheel (not shown) is similarly mounted to the distal end of the right member (not shown). A foot pedal 176 is also secured by the same axle 172 at the distal end 174 of the lower portion 168 of the limb structure 158. A foot pedal is similarly secured to the right distal end of the right member.

A stop, here shown in the form of a bar 178, is welded or otherwise secured to the underside 180 of the support member 146. It extends outwardly therefrom a distance sufficient to engage the lower portion 168 of the left member 160 as well as the lower portion of the right member (not shown). The stop 178 is positioned along the underside 180 to fix the first position of the riding exerciser. The second position of the riding exerciser, in which the limb structure 158 is rotated towards 182 the user positioned on the seat 152 and in which the support member 146 rotates towards the limb structure 158, is limited by the user on the seat 152. Of course, further rotation of the limb structure 158 through the second position and thereafter continuing to urge the limb structure to move places the limb structure as well as the user support structure in the storage configuration comparable to the storage configuration shown in FIG. 2.

As shown in FIG. 3, a resistance cylinder 186 is connected at its lower end 188 by a bushing 190 to a lower bracket 192 by a bolt 194. The other end and more particularly the piston 196 also has a bushing 198 associated therewith which is rotatably connected by a bolt 200 to a bracket 202. The cylinder 186 resists movement of the limb structure 158 between the first position and the second position. It also resists movement of the limb structure 158 from its use configuration as shown in FIG. 3 to the storage configuration comparable to that shown in FIG. 2.

It may be noted in FIG. 3 that upper surface 204 of the left beam 142 as well as the upper surface of the corresponding right beam (not shown) function as the cam surface for movement of the left wheel 170 and the right wheel during operation of the riding exerciser between a first position and the second position as well as during reorientation between the use configuration shown in FIG. 3 and the storage configuration similar to the storage configuration of FIG. 2.

It may be noted in reference to the resistance cylinder 186 that the bushings 190 and 198 are secured to their respective brackets 202 and 192 by bolts 200 and 194 or other comparable structure including pins, axles or the like.

The bracket 192 shown in FIG. 3 is attached to the inside surface of the beam 142. A corresponding bracket, not shown, is attached to the inside surface of the right beam, not here shown. Spacers may be used to extend between the right bracket, not shown, and the bracket 192 to centrally position the bushing 190 on the pin or bolt 194.

Figure 4:
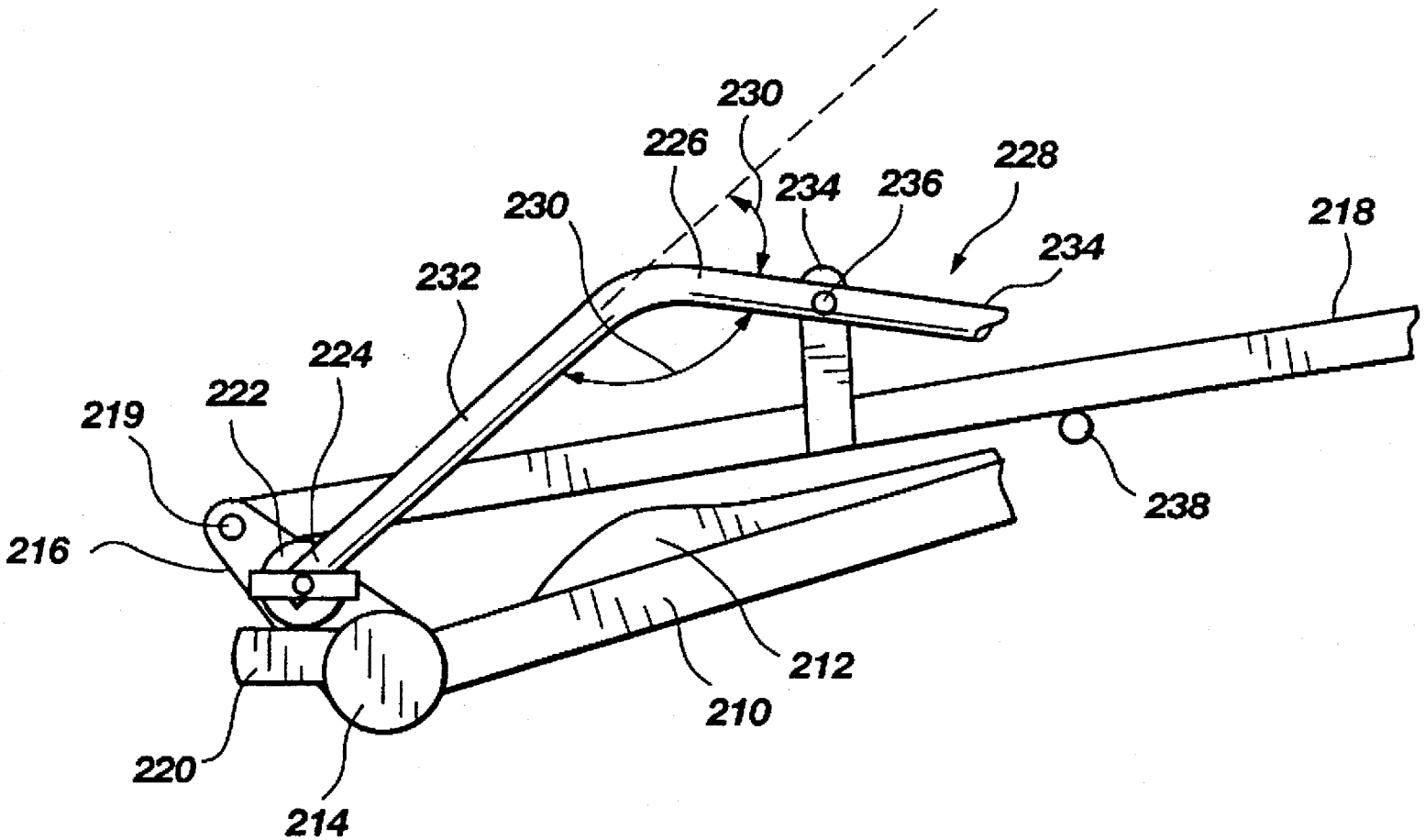
FIG. 4 is a partial, simplified view of the front portion of an alternate riding exerciser of the invention.

Referring now to FIG. 4, a partial side view of an alternate configuration is shown in which the left beam 210 has cam structure 212 secured thereto. The left beam 210 and a right beam (not shown) are connected to a forward foot 214. A left bracket 216 and a right bracket (not shown) are secured to the forward foot 214 to extend upwardly and forwardly therefrom. The support member 218 is rotatably secured to the left bracket 216 and right bracket, not shown, by an axle 219 which may be a bolt, a pin or other comparable structure which functions as an axle.

An extension 220 is secured to the forward foot 214 to extend away therefrom. When the riding exerciser of FIG. 4 is positioned in the storage configuration, it can be seen that the wheel 222 secured to the distal end 224 of the right support 226 of the limb structure 228 proceeds forwardly past the forward foot 214 onto the extension 220. The additional length of the left beam 210 provided by the extension 220 produces a different geometric configuration in which the angle 230 between the lower portion 232 and the upper portion of the right support 226 is increased. That is, the angle 230 was made to be a larger obtuse angle thereby minimizing the overall height or thickness of the box into which an assembled riding exerciser of FIG. 4 will be placed for shipment.

It can be seen in FIG. 4, that the limb structure 228 and more particularly the left upright member 236 and the right upright member (not shown) are secured to the support member 218 by bracket 234 by a limb axle 236. A stop 238 is also provided to define the first position when the machine is placed in the use configuration comparable to that shown in FIGS. 1 and 3. The resistance structure is not here shown for simplification.

Figure 5:
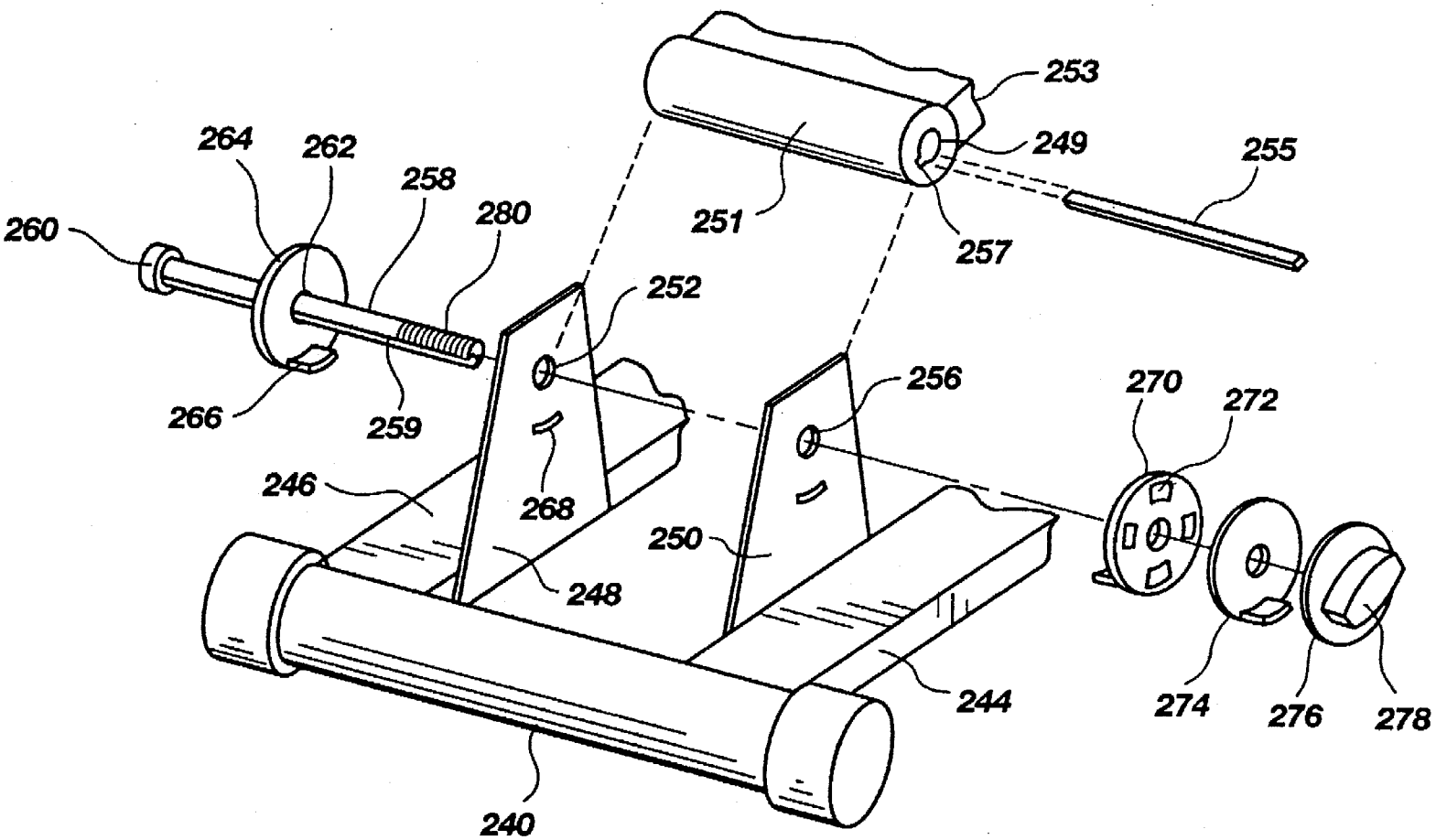
FIG. 5 is a perspective, exploded, simplified view of the front portion of an alternate riding exerciser of the invention.

Turning now to FIG. 5, the forward portion of a riding exerciser is shown with compressive resistance structure associated with the bolt 258 which functions as an axle. A front foot 240 has a right beam 246 and a left beam 244 both secured thereto. A right bracket 248 and a left bracket 250 are each secured to their respective right beam 246 and left beam 244.

As can be seen, the brackets 248 and 250 each have a respective aperture 252 and 256 formed therein to receive a bolt 258. The bolt 258 extends through the apertures 252 and 256 as well as an aperture 249 in bushing 251 which is on the front end of the support member 253 comparable to a support member 40. The head 260 of the bolt 258 abuts a thrust washer 264. The thrust washer has tongue 266 which registers with slot 268 to prevent rotation of the washer 264 in operation. The washer 264 has the aperture 262 and the aperture 249 is formed in the bushing 251 to receive the bolt 258. A key 255 inserts into notch 257 and a notch 258 formed in bolt 258 to lock the bushing 251 to the bolt 259 and to provide for rotation of the bolt 258 upon movement of the support member 253.

A friction disk 270 may have any one or more of a plurality of resistance pads 272 secured to one surface thereof to interface with a disk 274 positioned to interface therewith. The disk 274 is locked to knob 276 to rotate with the knob 276 and the bolt 258. The knob 276 with a handle 278 is threadedly engageable with the threads 280 on the end of the bolt 258.

In operation, the user operates the handle 278 in order to compress the disk 274 against the friction disk 270 and the pads 272 to increase the compression and, in turn, the resistance of rotation of the bolt 258 which is secured to the bushing 251.

Figure 7:
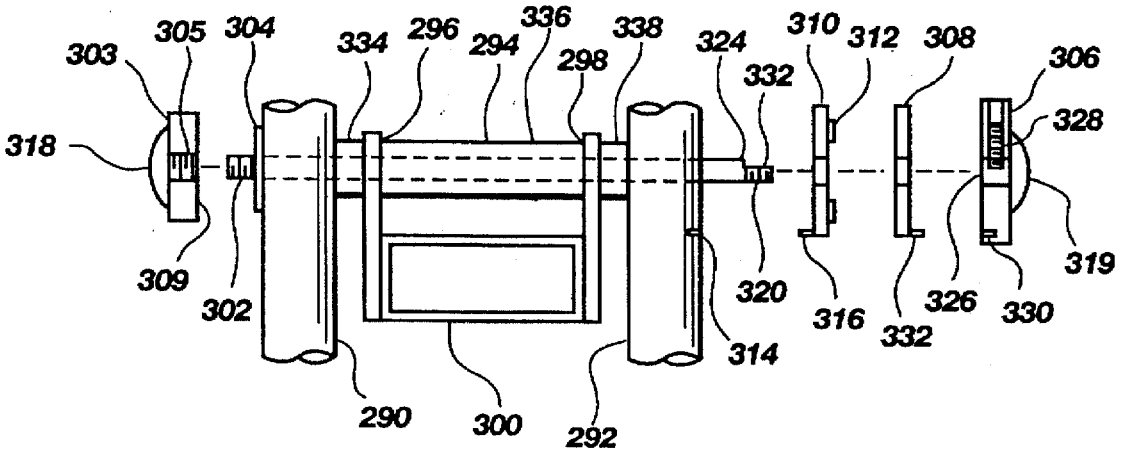
FIG. 7 is a partial, frontal view of an alternate arrangement of a riding exerciser of the invention.

FIG. 7 shows an alternate configuration of riding exerciser in which the left member 290 and the right member 292 are shown attached by a bolt 294 to upright brackets 296 and 298 which are welded to the support member 300. The bolt 294 functions as a limb axle to which compressive resistive structure is associated. The bolt 294 has a threaded head end 302. The knob 303 has a threaded aperture 305 sized to threadedly engage the head end 302. Upon rotation, the inside surface 309 of the knob 303 presses against a washer 304. The bolt 294 extends through apertures formed in the upright 290 and the upright 292 as well as through the brackets 296 and 298 for interconnection with an end cap 306. The end cap 306 urges plate 308 against the friction pads 312 of disc 310. The disc 310 is held from rotation by a slot 314 formed in the right member 292 to register with a corresponding tab 316 on the disc 310. Upon operation of the handles 318 or 319, the user may thus increase the pressure on the friction pads 312 to in turn increase the resistance to rotation of the bolt 294 and in turn increase the resistance to rotation of the limb member and the support member 300.

It may be noted that the bolt 294 has a threaded aperture 320 formed in a flattened portion 322 at the end 324. The flattened portion 322 registers with an aperture 326 formed in the end cap 306. A set screw 328 may be operated to threadedly engage the aperture 320 to in turn secure the end cap 306 to the bolt 294. The end cap 306 also has a slot 330 which mates with a tap 332 of the plate 308. In turn, rotation of the left upright 290 and right upright 292 causes relative motion between the disc 310 and the plate 308. The resulting friction is regulated by the compressive forces imposed by operation of either handle 318 or 319. The friction in turn resists rotation not only of the uprights 290 and 292 but in turn the support member 300.

To prevent inward compressive forces from bending the upright brackets 296 and 298, spaces 334, 336 and 338 are provided as shown.

The machines of FIGS. 5 and 7 may be operated by simply rotating the handles 318 or 319 and 278 to vary the resistance and in turn vary the degree of difficulty of the exercise. For the embodiments of FIGS. 1, 2 and 3, the user operates the resistance cylinder to vary the resistance of the cylinder during the course of performance of the exercise.

Reference herein to specific details and specific embodiments is only by way of example and is not intended to limit the scope of the claims which themselves recite those features which are presently regarded as essential to the invention.

What is claimed is:

1. A riding exerciser comprising:

a base for positioning on a support surface, said base having a front and a rear, and said base having a guide surface between said front and said rear;

a support member rotatably attached to said base and movable between a storage configuration in which said support member is positioned proximate said base and a use configuration in which said support member is spaced away from said base and said support member being configured to have a first end movable between a first position and a second position spaced away from said first position when in said use configuration;

user contact structure attached proximate said first end of said support member to support a riding user thereon, said user contact structure being movable with said first end of said support member between said first position and said second position when said support member is in said use configuration;

limb structure rotatably attached to said support member, said limb structure having a distal end with handle structure and a proximal end having foot supports positioned proximate thereto to support the feet of a user, said limb structure being shaped to be movable between a storage configuration in which said limb structure is positioned proximate to and in general alignment with said support member and a use configuration in which said handle structure is positioned for grasping by a user positioned on said user contact structure, and said limb structure being movable in said use configuration between a first position when said first end of said support member is in its first position and a second position spaced away from said first position of the limb structure when said first end of said support member is in its second position;

guide means attached proximate the proximal end of said limb structure for contact with and movement along said guide surface; and resistance means for resisting movement of said user support means and said limb structure between their respective first positions and second positions when said support member and said limb structure are in their respective use configurations, said resistance means being interconnected between any two of said limb structure, said user support means and said base.

2. The riding exerciser of claim 1, wherein said guide means includes wheel means rotatably mounted proximate the proximal end of said limb structure to rotate in movement along said guide surface when said limb structure is in its use configuration.

3. The riding exercise of claim 2, wherein said support member has a second end, and wherein said support member is rotatably mounted to said base proximate said second end.

4. The riding exerciser of claim 3, wherein said limb structure includes a pair of spaced apart members with said support member rotatably attached thereinbetween.

5. The riding exerciser of claim 4, wherein said base includes a pair of spaced apart beams with a front foot attached proximate the front and a rear foot attached proximate the rear.

6. The riding exerciser of claim 5, wherein said wheel means includes a wheel positioned at the lower end of each of said pair of spaced apart members and wherein each of said pair of spaced apart beams is positioned with a surface for contact by one of said wheels.

7. The riding exerciser of claim 6, wherein each of said pair of spaced apart beams has a cam surface affixed thereto for contact with said wheels when said riding exerciser is in said use configuration.

8. The riding exerciser of claim 7, wherein said resistance means includes an hydraulic cylinder rotatably connected at one end to said support member and rotatably connected to said base at its other end.

9. The riding exerciser of claim 8, wherein said support member is rotatably connected to said base by a support axle and wherein resistance means is compressive resistance structure associated with said support axle.

10. The riding exerciser of claim 8, wherein said limb structure is rotatably attached to said support member by a limb axle, and wherein said resistance means is compressive resistance structure associated with said limb axle.

11. The riding exerciser of claim 8, wherein said limb structure is rotatably attached to said support member by a limb axle, wherein said support member is rotatably secured to said base by a support axle, and wherein said spaced apart members each have a portion between said limb axle and said wheels which is arcuately formed to extend rearwardly and which is sized in effective length to be proximate the distance between the limb axle and the support axle.

* * * * *